343-872 SR
4/28/87 XR 4,661,821

United States Patent [19]
Smith

[11] Patent Number: 4,661,821
[45] Date of Patent: Apr. 28, 1987

[54] VANDALISM-RESISTANT UHF ANTENNA

[75] Inventor: Alan M. Smith, Hendersonville, N.C.

[73] Assignee: General Electric Company, Schenectady, N.Y.

[21] Appl. No.: 712,053

[22] Filed: Mar. 15, 1985

[51] Int. Cl.[4] ..... H01Q 1/42; H01Q 7/00
[52] U.S. Cl. ..... 343/743; 343/846; 343/872
[58] Field of Search ..... 343/743, 829, 872, 873, 343/846

[56] References Cited

U.S. PATENT DOCUMENTS 3,623,161 11/1971 Fujimoto et al. ..... 343/829
3,641,576 2/1972 Farbanish ..... 343/743
3,696,431 10/1972 Holland ..... 343/829

*Primary Examiner*—Eli Lieberman
*Attorney, Agent, or Firm*—John P. McMahon; Philip L. Schlamp; Fred Jacob

[57] ABSTRACT

A vandalism-resistant antenna for the UHF band comprises a ring-shaped radiator printed on a dielectric board or disc mounted within a shallow enclosure of insulating material having high impact strength. The radiator is approximately ¼ wavelength long at the operating frequency and is located at a constant spacing above a ground plane. A coaxial RF connector fastens the radiator-board assembly to a mounting surface serving as the ground plane, and couples the antenna to a transmitter or receiver.

5 Claims, 5 Drawing Figures

Fig. 1
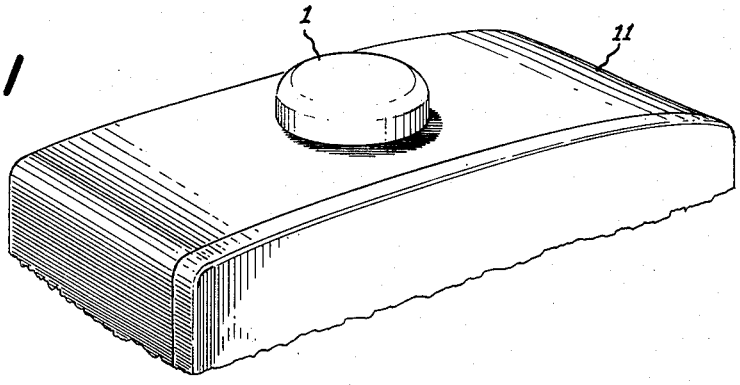
Fig. 2
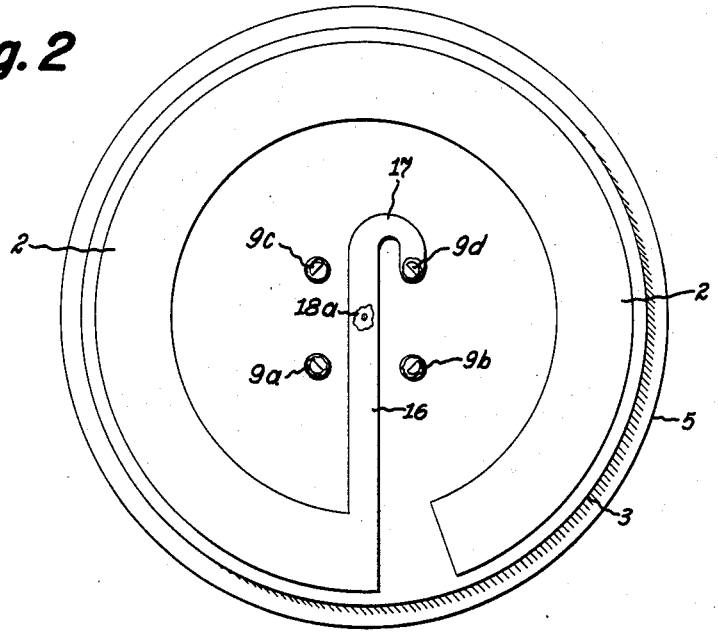
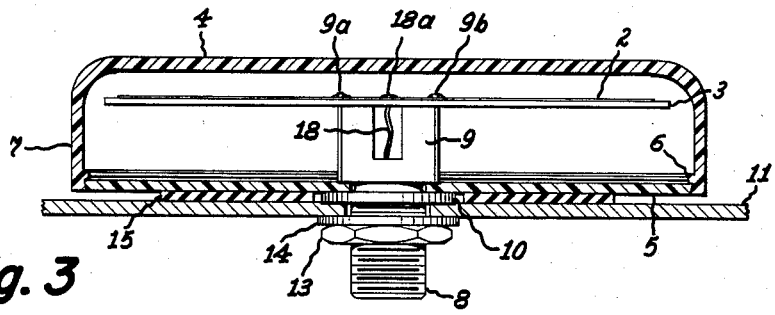
Fig. 3

VANDALISM-RESISTANT UHF ANTENNA

This invention relates to an antenna for the ultra high frequency band which is compact, inconspicuous and resistant to vandalism.

BACKGROUND OF THE INVENTION

In many radio transmitting or receiving applications, as for instance on exposed controller boxes or in mobile communications or paging systems, the mounting location of the antenna must be near ground level. Almost inevitably the mounting arrangement leaves open the possibility of antenna theft or vandalism. Slender dipole or whip-like antennas are particularly vulnerable. To substantially reduce such threat, the antenna must be of rugged construction and preferably inconspicuous. In the ultra-high-frequency (UHF) band where wavelengths are measured in inches or centimeters, certain antenna designs make dimensional accuracy very critical and add thereby to the cost of manufacturing the antenna. To date a low cost antenna possessing the desired vandalism-resistant character while achieving good performance has not been available.

SUMMARY OF THE INVENTION

The object of the invention is to provide for the UHF band an antenna having good performance and which, by virtue of its compactness, ruggedness and inconspicuousness, is particularly suited to neighborhoods where vandalism or theft is a constant threat.

A vandalism-resistant antenna embodying my invention comprises a ring-shaped radiator in the form of a printed circuit on a dielectric board or disc, mounted within a shallow enclosure of insulating material having high impact strength. The radiator is preferably approximately $\frac{1}{4}$ wavelength long at the operating frequency and is located at a constant spacing above a ground plane. A coaxial type radio frequency (RF) connector is incorporated as part of the antenna structure and serves both as a means for fastening the radiator-board assembly to a mounting surface serving as the ground plane, and for coupling the antenna to the appropriate transmitter or receiver.

DESCRIPTION OF DRAWINGS

In the drawings:

FIG. 1 is a pictorial view of a vandal-resistant antenna embodying the invention and contained within a shallow enclosure mounted on top of a lighting controller box.

FIG. 2 is a top plan view of one antenna structure embodying the invention, shown with the cover of the enclosure removed.

FIG. 3 is a cross-sectional view of the antenna structure of FIG. 2.

DETAILED DESCRIPTION

Figure 4:
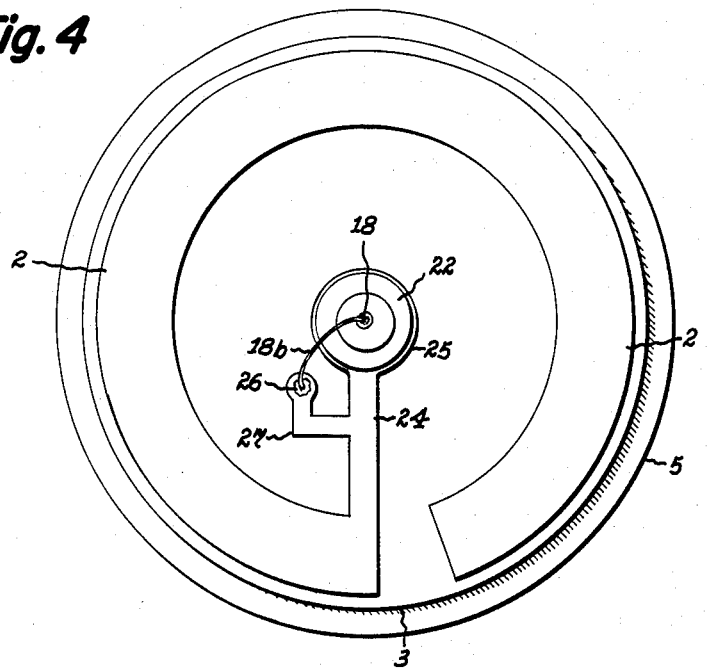
FIG. 4 is a top plan view of another antenna structure embodying the invention, shown with the cover of the enclosure removed.

The antenna structure mounted within the enclosure 1 pictured in FIG. 1 is shown in FIGS. 2 and 3. It comprises a ring radiator 2 about $\frac{1}{4}$ wavelength long formed by a thin layer of metal such as copper printed on a circular dielectric board or plate 3 of insulating material such as fiber glass-reinforced polyester plastic. As shown, it is sized for approximately 450 MHz, at which frequency a $\frac{1}{4}$ wavelength is 16.7 cm or approximately $6\frac{1}{2}$ inches. It may be made by conventional printed circuit photographic processes which assure dimensional accuracy.

The printed board is mounted within the shallow enclosure formed by a cover member 4 and a bottom plate 5, both consisting of high impact plastics such as acrylonitrile-butadiene-styrene (ABS) polymer or polycarbonate (Lexan}polymer. The plastic material of the enclosure is preferably pigmented or painted to the same color as the mounting surface. A ridge 6 on the inside wall of the cover serves to locate the bottom plate which is dimensioned to snap into place by stretching the cylindrical side wall 7 slightly. The bottom plate is preferably also cemented in place to seal the enclosure and to increase its strength and resistance to blows. As can be seen from FIG. 1, the enclosure has a very low profile, somewhat like a hockey puck or like a miniature pie plate inverted, and presents an inconspicuous exterior which blends into the mounting surface. Its rugged construction enables it to withstand severe blows from vandals without damage to the internal components.

The printed board 3 is supported within the enclosure by a conventional female type coaxial RF connector comprising an externally threaded lower portion 8 and a rectangular four corner post upper portion 9 made of metal which is wetted by solder or alternatively plated with such metal wherever soldering is required. The four posts have reduced top portions extending through holes in board 2 which are encircled by copper rings printed on the plastic material. The board is permanently fastened to the connector by soldering the top portions of the posts to the copper rings at 9*a* to 9*d*. The base of the rectangular portion 9 of the connector is seated on bottom plate 5. The spacing and the dielectrics between the metal layer forming the ring radiator 3 and the ground plane on which the antenna is mounted are important factors in determining the antenna characteristic impedance. The spacing is determined by the thickness of board 3, the height of connector portion 9, the thickness of bottom plate 5 and the thickness of spacer 10.

The antenna 1 is mounted on a street lighting controller box 11 as shown in FIG. 1 by first drilling a hole in the top of the box. A spacer washer placed around the lower portion 8 of the connector which is then extended through the hole. A nut 13 under a lockwasher 14 within the controller box is tightened to lock the antenna in place. A compressible gasket 15 under the bottom plate seals the box and prevents entry of water.

The printed ring radiator 2 forms a grounded dipole which is capacitively loaded throughout its length. It is grounded at its base through the printed radial arm 16 which passes between the post ends 9*a* and 9*b*, continues between the post ends 9*c* and 9*d*, and then doubles back at 17 toward post end 9*d* to which it is soldered. Post 9*d* extends the exterior conductor or sheath of the coaxial connector which is part of the ground plane. At the central point between the post ends, the center conductor 18 of the coaxial connector 8 is extended up through an aperture in board 3 and through a hole at 18*a* in printed arm 16 at which point it is soldered to the printed arm. The distance from ground point 9*d* around loop 17 to tap point 18*a* determines the ohmic antenna value seen by the coaxial line. The preferred value is 50 ohms, and the dimensions of the printed arm 16 and of the loop 17 can be varied to achieve such value or some other desired value.

Figure 5:
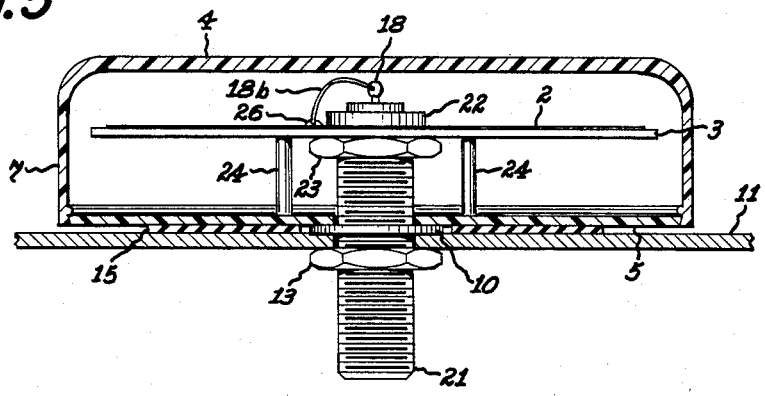
FIG. 5 is a cross-sectional view of the antenna structure of FIG. 4.

FIGS. 4 and 5 show another antenna structure embodying the invention and which may be contained within enclosure 1 or some other low profile insulating housing. In this variant the same reference numerals are used to denote corresponding parts which have already been described with reference to FIGS. 2 and 3. The printed board 3 is supported by a conventional chassis-mount coaxial RF connector comprising an externally threaded tubular portion 21 terminating in an expanded ring or collar 22. The connector extends down through a central hole in board 3, the collar 22 engaging the top of the board and a nut 23 being tightened under the board to effect a secure attachment. The height or spacing of the board above bottom plate 5 is determined by four posts 24 molded integrally with the bottom plate from which they rise to engage the underside of board 2. The connector extends through bottom plate 5, spacer 10 and top wall 11 of the controller box. Printed board 3 is fixed in enclosure 1 by tightening nut 13 under the top of a controller box in the same way as in the assembly of FIGS. 2 and 3.

The coupling of ring radiator 2 to the coaxial connector in FIGS. 4 and 5 is as follows. The ring radiator is grounded at its base through the printed radial arm 24 which extends into an printed ring 25 encircling the central hole in the board. The collar 22 of the RF connector is seated on ring 25 and thus the ground plane is extended to it and to the base of the antenna. The center conductor 18 of the coaxial line is extended, or alternatively connected by means of a soldered jumper **18*b* if preferred, to the end 26 of an inductive branch 27 which makes a right angle turn before joining arm 24. The dimensions of the inductive branch and the point of connection to arm 24 may be varied to achieve a 50 ohm tap or other desired value of input resistance. A coaxial cable (not shown) conventionally connects connector 21** within the controller box to the radio receiver housed in the box.

The electrical design of the present antenna for the UHF band is in many respects akin to that of the directional discontinuity ring radiator (DDRR) antenna occasionally used in the VHF band. Its electrical performance is similar to that of an ordinary $\frac{1}{4}$ wavelength vertical whip antenna subject to a 1 to 2 decibels reduction in gain. Its mechanical features including the use of a printed circuit board and the fewness of the soldered joints make for low manufacturing cost together with dimensional accuracy assuring constant electrical performance.

The specific antenna designs which have been illustrated and described are intended by way of example of the invention only, and its scope is to be determined by the appended claims which are intended to cover any modifications coming within its spirit.

What I claim as new and desire to secure by Letters Patent of the United States is:

1. A vandalism-resistant antenna for ultra high frequencies comprising:

a ring-shaped radiator printed on a dielectric board, a shallow enclosure of insulating material having high impact strength, mounting means for holding said board within said enclosure and for fastening said enclosure to a conducting surface member serving as a ground plane whereby to locate said radiator at a substantially constant distance above a ground plane, and means for coupling a coaxial RF line to said radiator.

2. An antenna as in claim 1 wherein said means for coupling said radiator to said coaxial RF line comprise a printed radial arm on said board extending from one end of said radiator to the outer conductor of said coaxial line, and a connection from the inner conductor of said coaxial line to an intermediate point on said radial arm.

3. An antenna as in claim 2 wherein said mounting means comprise a coaxial RF line connector projecting centrally into said shallow enclosure through the bottom thereof and supporting said dielectric board therein.

4. An vandalism-resitant antenna for ultra high frequencies comprising:

a ring-shaped radiator printed on a dielectric board, a shallow enclosure of insulting material having high impact strength, mounting means for holding said board within said enclosure comprising a four corner post outer conductor portion terminating at said dielectric board and projecting centrally into said shallow enclosure through the bottom thereof and supporting said dielectric board therein, said mounting means fastening said enclosure to a conducting surface member serving as a ground plane whereby to locate said radiator at a substantially constant distance above a ground plane, and means for coupling a coaxial RF line to said radiator comprising a printed radial arm which passes centrally between said four posts, and doubles back toward and terminates at one of the posts, and an inner conductor of said four corner post outer conductor which terminates at said radial arm at the central point between said four posts.

5. A vandalism-resistant antenna for ultra high frequencies comprising:

a ring-shaped radiator printed on a dielectric board, a shallow enclosure of insulating material having high impact strength, mounting means for holding said board within said enclosure comprising an outer conductor terminating at said dielectric board and projecting centrally into said shallow enclosure through the bottom thereof and supporting said dielectric board therein, said mounting means fastening said enclosure to a conducting surface member serving as a ground plane whereby to locate said radiator at a substantially constant distance above a ground plane, and means for coupling a coaxial RF line to said radiator comprising a printed radial arm which terminates at and engages directly said outer conductor and has an inductive branch joining it at an intermediate point, and a conductor connecting an inner conductor of said outer conductor to said inductive branch.

* * * * *